US007055447B1

(12) United States Patent
Bekker

(10) Patent No.: US 7,055,447 B1
(45) Date of Patent: Jun. 6, 2006

(54) DYNAMIC POSITIONING AND MOTION CONTROL DURING CARGO TRANSFER OPERATIONS

(76) Inventor: Joannes R. Bekker, 5206 Westridge Pl., Houston, TX (US) 77041

( * ) Notice: Subject to any disclaimer, the term of this patent is extended or adjusted under 35 U.S.C. 154(b) by 0 days.

(21) Appl. No.: 11/251,302

(22) Filed: Oct. 14, 2005

(51) Int. Cl.
*B63H 25/46* (2006.01)

(52) U.S. Cl. ..... 114/151; 440/1; 440/5

(58) Field of Classification Search ..... 114/151; 440/1, 5

See application file for complete search history.

(56) References Cited

U.S. PATENT DOCUMENTS 5,274,378 A * 12/1993 O'Conner ..... 342/23
5,787,832 A * 8/1998 Spinka ..... 114/123
6,278,937 B1 * 8/2001 Ishida et al. ..... 701/207
6,668,746 B1 12/2003 Schia et al.
6,672,236 B1 * 1/2004 Pinsof ..... 114/151
6,799,528 B1 * 10/2004 Bekker ..... 114/151
6,848,380 B1 2/2005 Sainz
6,848,382 B1 * 2/2005 Bekker ..... 114/144 B
6,912,965 B1 * 7/2005 Leitch et al. ..... 114/61.12

* cited by examiner

*Primary Examiner*—Stephen Avila
(74) *Attorney, Agent, or Firm*—Buskop Law Group, P.C.; Wendy Buskop

(57) ABSTRACT

A system and method providing a portable, floatable vessel for controlling the absolute position and relative position and the motion of a floating craft using a small water plane area, high vertical drag coefficient and dynamic positioning is disclosed. The methodology employs a portable, floatable vessel that includes: a bridge structure, a lifting bridle connected to the bridge structure, a control center, first and second struts connected to the bridge structure, and first and second docking arms connected to the struts. The first and second struts are connected to first and second machinery pods with first and second azimuth thrusters for self-propulsion, motion control, and other operations while in water. Docking arms include drag dishes for stabilization and arm pods for buoyancy control of the docking arms. The docking brackets can firmly grip and stabilize the floating craft to minimize roll, pitch, yaw, and other motions of the craft during cargo transfer. The control center employs a dynamic positioning system for maneuverability and for controlling horizontal plane motion of the portable, floatable vessel.

13 Claims, 2 Drawing Sheets

DYNAMIC POSITIONING AND MOTION CONTROL DURING CARGO TRANSFER OPERATIONS

FIELD

The present embodiments relate generally to a stabilizing floating vessel for a floating craft and a method for stabilization of a floating craft, such as a lightering craft.

BACKGROUND

Large ocean going ships have a need to off-load cargo to smaller lightering crafts when large ocean going ships cannot dock in a port. In high seas, such as gale force winds, the lightering crafts cannot safely receive cargo from the ocean going supply ships; and therefore, off-loading is halted until sea conditions improve. In addition, the subsequent movement of the ships and crafts due to wave motions can create dangerous conditions for operations using lifting cranes. Accordingly, waiting for calm sea conditions in order to resume crane and cargo off-loading operations can be costly and time-consuming.

Thus, a need exists for a vessel and method for providing stabilization of a lightering craft that can greatly suppress the motions of the lightering craft, as well as maintain heading and position of the lightering craft to enable safer operations between the craft and a larger supply ship.

The present embodiments of the invention address these needs.

SUMMARY

The present embodiments of the invention relate generally to a portable, floatable vessel for dynamic positioning and stabilization of any lightering craft or similar small craft.

The portable, floatable vessel includes a bridge structure, a lifting bridle connected to the bridge structure, and a first strut and a second strut connected to the ends of the bridge structure. The first and second struts are connected to first and second machinery pods with each pod having a diesel-engine hydraulic power unit connected to a fuel tank and azimuth thrusters for providing self-propulsion through water, such as the sea, or a canal, or even a lake. The invention contemplates using machinery pods with profiles that provide a high vertical drag coefficient enabling suppression of vertical motion of the portable, floatable vessel and any floating vessel to which it is engaged.

Further, the vessel includes a first docking arm and a second docking arm rotatably mounted to the first strut and the second strut, respectively. Each docking arm includes a docking bracket, located opposite the bridge structure, for gripping and stabilizing the lightering craft. The docking bracket is of a shape to snugly engage contact areas on the floating vessel. It is contemplated that the docking brackets can be removable and replaceable to adapt to different types of vessel. For example, the docking arms may be box-shaped to engage military amphibious landing craft, while being articulated fingers hydraulically engagable to grip a barge, or other tendering vessel.

Each docking arm also includes a docking arm strut connected substantially perpendicular to the docking arm. The docking arm strut can engage the docking arm at a 90 degree angle or range, such as, between 70 and 110 degrees. An arm pod for providing buoyancy is attached to each docking arm. The arm pods can be permanently ballasted such as with concrete in the bottom of the pods, or the arm pods can have adjustable buoyancy using multiple chambers with valves and pneumatic air enabling the bracket to be at exactly the right elevation to securely engage the floating craft.

A drag dish is secured to each arm pod for providing stabilizations for the floating vessel, thereby minimizing motion to the floating craft. The drag dish retards vertical motion of the floating vessel for enhanced stability. The drag dish can be a round plate, or be a cylinder that is hollow with a diameter larger than the arm strut. The drag dish in an embodiment can additionally operate to provide additional buoyancy control, like the arm pod.

An arm cylinder is connected between the bridge structure and the docking arm to control movement of the docking arms and to manipulate the docking arms. The docking arms can swing out to a range of about 120 degrees from the bridge structure and, in another embodiment, it is contemplated that the docking arms are fully retractable, in a manner similar to the crossing of a persons arms across their chest.

A control center is included in the system for communication with the machinery pods, the azimuth thrusters, the docking arms, and the arm cylinders. The control center includes a dynamic positioning system (DPS) that interacts with a computerized navigation system for maneuverability of the portable, floatable vessel and machinery pods. The portable, floatable vessel can be lifted by a larger supply ship using the portable, floatable vessel's lifting bridle and crane operations of the supply ship for single point lifting.

BRIEF DESCRIPTION OF THE DRAWINGS

The detailed description will be better understood in conjunction with the accompanying drawings as follows.

Figure 1:
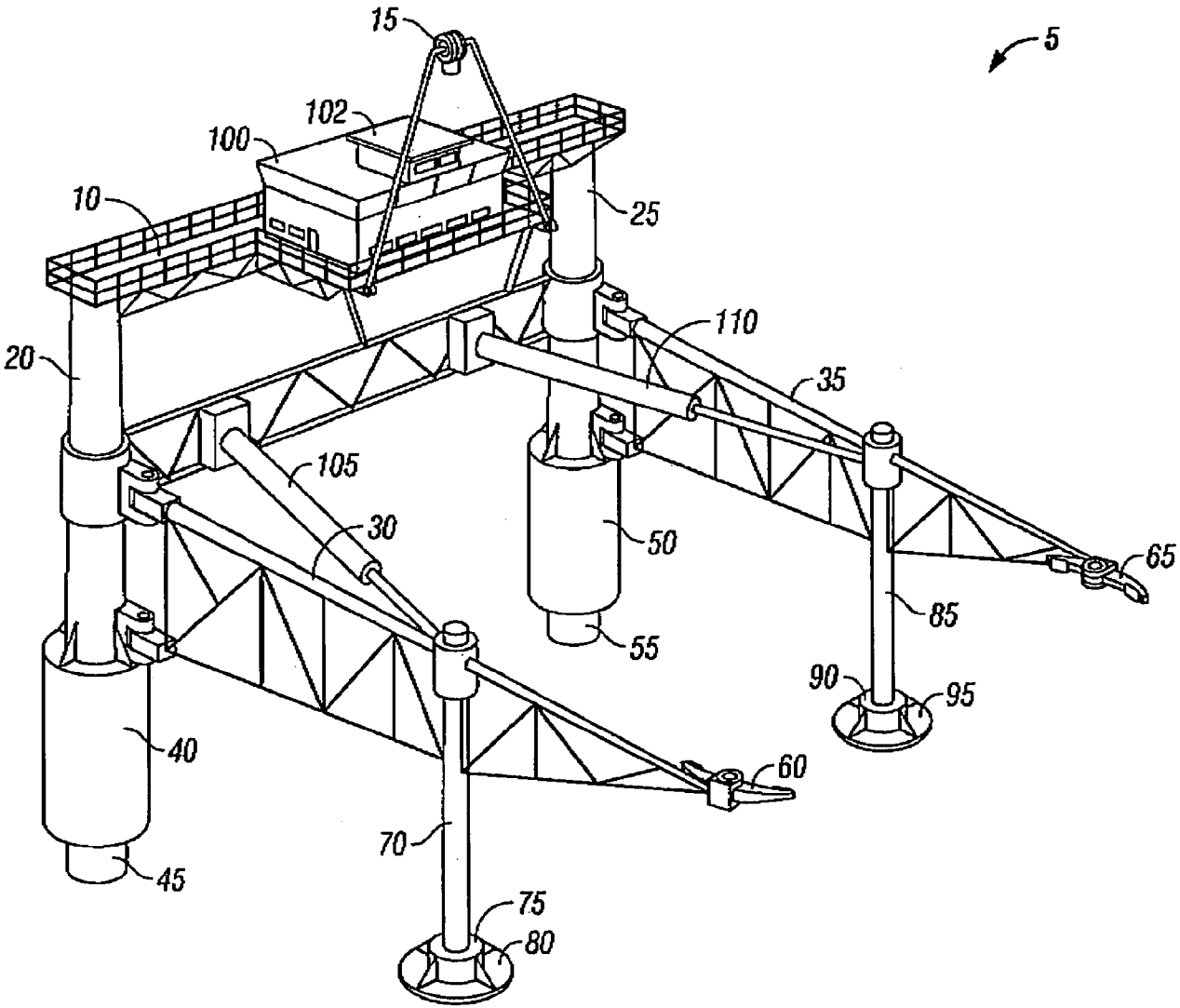
FIG. 1 depicts a perspective view of the portable, floatable vessel according to the invention.

The present embodiments are detailed below with reference to the listed Figures.

DETAILED DESCRIPTION OF THE EMBODIMENTS

Before explaining the present embodiments in detail, it is to be understood that the invention is not limited to the particular embodiments and that the invention can be practiced or carried out in various ways.

The present embodiments of the invention relate generally to a portable, floatable vessel for dynamic positioning and stabilization of any lightering craft or similar small craft.

The portable, floatable vessel includes a bridge structure, a lifting bridle connected to the bridge structure, and a first strut and a second strut connected to the ends of the bridge structure. The first and second struts are connected to first and second machinery pods with each pod having a diesel-engine hydraulic power unit connected to a fuel tank and azimuth thrusters for providing self-propulsion through water, such as the sea, or a canal, or even a lake. The invention contemplates using machinery pods with profiles that provide a high vertical drag coefficient enabling suppression of vertical motion of the portable, floatable vessel and any floating vessel to which it is engaged.

Further, the vessel includes a first docking arm and a second docking arm rotatably mounted to the first strut and the second strut, respectively. Each docking arm includes a docking bracket, located opposite the bridge structure, for gripping and stabilizing the lightering craft. The docking bracket is of a shape to snugly engage contact areas on the floating vessel. It is contemplated that the docking brackets can be removable and replaceable to adapt to different types of vessel. For example, the docking arms may be box-shaped to engage military amphibious landing craft, while being articulated fingers hydraulically engagable to grip a barge, or other tendering vessel.

Each docking arm also includes a docking arm strut connected substantially perpendicular to the docking arm. The docking arm strut can engage the docking arm at a 90 degree angle or range, such as, between 70 and 110 degrees. An arm pod for providing buoyancy is attached to each docking arm. The arm pods can be permanently ballasted such as with concrete in the bottom of the pods, or the arm pods can have adjustable buoyancy using multiple chambers with valves and pneumatic air enabling the bracket to be at exactly the right elevation to securely engaging the floating craft.

A drag dish is secured to each arm pod for providing stabilizations for the floating vessel, thereby minimizing motion to the floating craft. The drag dish retards vertical motion of the floating vessel for enhanced stability. The drag dish can be a round plate, or be a cylinder that is hollow with a diameter larger than the arm strut. The drag dish, in an embodiment, can additionally operate to provide additional buoyancy control, like the arm pod.

An arm cylinder is connected between the bridge structure and the docking arm to control movement of the docking arms and to manipulate the docking arms. The docking arms can swing out to a range of about 120 degrees from the bridge structure and in another embodiment, it is contemplated that the docking arms are fully retractable, in a manner similar to the crossing of a persons arms across their chest.

A control center is included in the system for communication with the machinery pods, the azimuth thrusters, the docking arms, and the arm cylinders. The control center includes a dynamic positioning system (DPS) that interacts with a computerized navigation system for maneuverability of the portable, floatable vessel and machinery pods. The portable, floatable vessel can be lifted by a larger supply ship using the portable, floatable vessel's lifting bridle and crane operations of the supply ship for single point lifting.

The floating craft can include any craft with a hull, at least two sides, a bow, a stern, and a deck connecting the two sides. The floating craft can be a lightering craft.

One of the advantages of the present invention is the provision of a floating vessel with a small water plane area for use in lightering operations. By having a small water plane area, changes in the water level by surging sea, result in small changes in water displacement of the vessel. This vessel will not go up and down as much as the surrounding sea. That is, heave is significantly reduced in this vessel. This invention provides enhanced stability, particularly usable in lightering operations. The small water plane area of the vessel of the invention is limited to the horizontal cross sectional area of the four struts of the vessel.

Advantageously, this portable, floating vessel and method for providing dynamic positioning and stabilization of a lightering craft greatly suppresses the motions of the craft, such as roll, pitch, and yaw, and enables safer operations, such as safer lightering operations for cargo transfer between supply ships and lightering crafts. In addition, the portable, floatable vessel can grip the lightering craft to create a multi-hull structure for increased stability. Also, vertical drag dishes and pods attached to the floating vessel can increase stability in the water. In an embodiment, the vessel has an open latticed construction of the bridge and the docking arms to minimize wind drag of the vessel.

By combining a high vertical drag coefficient with a small water plane area, a vessel is formed that is minimally affected by pitch, roll and heave resulting from heaving seas.

Certain embodiments of the vessel include a bridge structure that can be composed of steel or a similar structural material and can be in the form of a lattice structure, using "crossed" or "M-shaped" beams for the lattice. The bridge can be structured into one or multiple levels and can have a length that depends on the floating craft to be stabilized. For example, for a military landing craft, utility 1600 class, a usable length bridge would be about 150 feet. The bridge can include a control center with a dynamic positioning system (DPS) interacting with a computer satellite network for navigation of the portable, floatable vessel and for controlling the propulsion system, which includes the machinery pods and azimuth thrusters.

The control center can be located in the center of an upper level of the bridge structure for adequate visibility by a control center operator of the portable, floatable vessel. The operator can maneuver the portable, floatable vessel using the computerized navigation system which interacts with the dynamic positioning system (DPS) for steering, positioning and docking the portable, floatable vessel and any attached lightering craft. The control center can include a remote control transmitter and receiver for accepting and sending navigation information remotely for unmanned operation.

The dynamic positioning system (DPS) system can employ a vessel joy-stick controller, such as an integrated wind compensated joy-stick controller, for docking arm control and azimuth thruster control. The dynamic positioning system (DPS) system and computerized navigation system can use laser rangers, such as fan beam laser rangers as primary position reference sensors. The laser rangers can be located on the bridge structure and can function with regard to positioning, including docking the vessel and any attached lightering craft.

The bridge structure can include grating and railings for personnel access between the control center and the hatches of the first and second struts, located on the ends of the bridge. Connected to the bridge structure and located over the control room can be a lifting bridle, which can be used for single point lifting of the portable, floatable vessel by crane operations. The lifting bridle can be made of cable, such as a steel wire cable.

The embodiments of the system include a first strut and a second strut. The first strut can be connected to the bridge structure on a first end and connected to a machinery pod with an azimuth thruster on the second end. The second strut can be connected to the bridge structure on a first end and connected to a machinery pod with an azimuth thruster on the second end. In an embodiment, the struts are hollow, and can have a diameter of 12 feet in diameter with a length of each strut in a range of from 20 feet to 100 feet. The struts can be single-walled or double-walled structures made of steel or a similar material. An embodiment of the strut contemplates the strut having an above water engine exhaust and also containing electrical wiring and conductors for use in refueling as well as fill and vent lines for the fuel tank. The struts can include a small water plane for minimizing wave induced motion and accelerations of the portable, floatable vessel.

The first strut can include a first machinery pod with a first power unit comprising an engine, such as a diesel-engine hydraulic power unit. It is contemplated that a Thrustmaster thruster, from Houston Tex., could be used in this embodiment. A first azimuth thruster connects to, or is disposed within, the first machinery pod. A first fuel tank is connected to the first power unit. The machinery pod can be made of steel or a similar material.

The second strut includes a second machinery pod with a second power unit. It is contemplated that the first and second strut would have similar, or matching power units, but two different sized power units or multiple power units can be installed in the pods and be usable herein. The second machinery pod can have a second azimuth thruster within the second machinery pod, and a second fuel tank connected to the second power unit. The first machinery pod and the second machinery pod can have a profile, that is, a shape that particularly provides a high vertical drag coefficient for suppressing vertical motion and increasing stability of the portable, floatable vessel.

The azimuth thruster can be a hydraulic azimuth thruster having at least one propeller and at least one motor. The azimuth thruster can produce: a propelling force, a turning capacity, a steering capability, a horizontal motion suppression, a vertical motion suppression, and combinations thereof.

The embodiments of the system include a first docking arm and a second docking arm that are rotatably mounted to the first strut and the second strut, respectively. For example, the mounting mechanism can be a hinge, a swiveling pin eye structure, or a clevis structure or a similar rotating but secure mounting device. The docking arms can fully extend to a length of about 100 feet. The docking arms can retract and fold over each other for storage, such as in the manner of a person's arms folding over their chest. Each docking arm can include a docking bracket. The arms can be fully retracted by folding them over each other to reduce the amount of deck space when the vehicle is stored on the supply ship.

The first and second docking brackets are located, each at the end of the docking arms, opposite the bridge structure, and can be adapted for firmly gripping the lightering craft on the bow or stern. The first and second docketing brackets can include a shape matching contact points of the portable, floatable vessel. Articulated fingers can be used for the docking bracket. Tapered extensions to facilitate the centering of the craft into the docking bracket can be used. The docking brackets can include fenders at the outboard ends.

A first arm strut is connected substantially perpendicular to the first docking arm. The first arm strut can connect, at the opposite end, to a first arm pod. The arm pod provides a floating or buoyancy function for the docking arm. A first drag dish can be connected to the first arm pod for creating a vertical drag to suppress vertical motion and increase stability. A first arm cylinder is connected between the bridge structure and the first docking arm. The first arm cylinder can be a hydraulic arm cylinder adapted for providing power to the attached first docking arm.

The second docking bracket is located at the end of the second docking arm, opposite the bridge structure, and can be adapted for firmly gripping the lightering craft on the bow or stern. For example, the first docking bracket can grip the bow of a military landing craft for carrying tanks. The second docking bracket can then grip the stern of the military landing craft. In an embodiment, the docking brackets are aligned to allow the gradual centering of the floating vessel within the docking brackets as the docking brackets close in on the floating vessel.

A second arm strut is connected substantially perpendicular to the second docking arm. The second arm strut can connect, at the opposite end, to a second arm pod for a floating or buoyancy function. A second drag dish can be connected to the second arm pod for creating a vertical drag to suppress vertical motion and increase stability. A second arm cylinder can be a hydraulic arm cylinder adapted for providing power to the attached second docking arm. The second arm cylinder is connected to the bridge structure and the second docking arm. Both arm cylinders can fully extend to a length of about 80 feet for the embodiment that contemplates using a 1600 series military landing craft. Other lengths can be used, depending on the size of the floating craft to be stabilized by the floating vessel.

Both docking arms, aided by both hydraulic arm cylinders, can extend and retract fully, can swing out to an angle of 120 degrees with respect to the bridge structure, and can fold over each other to reduce the amount of deck space when stored on a supply ship.

The embodiments of the invention include a method for dynamic positioning and stabilization of a lightering craft using a portable, floatable vessel. The portable, floatable vessel can be transferred to water from a supply ship using the lifting bridle of the portable, floatable vessel and crane operations of the supply ship.

The portable, floatable vessel maneuvers through the water, using the dynamic positioning system and the azimuth thrusters, to a position adjacent to the floating craft, which can be a lightering craft.

The portable, floatable vessel extends the first and second docking arms and grips the floating craft with the first docking bracket and the second docking bracket, to stabilize the lightering craft. The portable, floatable vessel uses the dynamic positioning system to maintain the lightering craft adjacent to the supply ship and stabilize the craft from horizontal movement. The azimuth thrusters are used to maintain the position of the floating craft with the dynamic positioning system (DPS) so that a transfer of cargo can occur. Next, the portable floatable vessel uses the azimuth thrusters to maneuver the floating craft to a position away from the supply ship. As a final step, the first docking bracket and the second docking bracket can open to release the floating vessel.

The portable, floatable vessel can be lifted back onto the supply ship using the lifting bridle and can be stored on the supply ship.

With reference to the figures, FIG. 1 depicts a diagram of the portable, floatable vessel (5). The portable floatable vessel (5) includes: a bridge structure (10); a lifting bridle (15) connected to the bridge structure (10); a first strut (20) and a second strut (25), that are connected to the bridge structure (10); and a first docking arm (30) and a second docking arm (35) that are connected to the struts.

The first strut (20) can be connected to a first machinery pod (40) with a first azimuth thruster (45) for self-propulsion, steering capabilities, and motion control through the water. The second strut (25) can be connected to a second machinery pod (50) with a second azimuth thruster (55).

The first and second docking arms (30 and 35) extend from the first and second struts (20 and 25). At one end of each docking arm is a docking bracket. The first docking arm (30) has a first docking bracket (60) and the second docking arm (35) has a second docking bracket (65), respectively, for firmly gripping and stabilizing a floating craft, such as a lightering craft. The first docking arm (30) includes a first arm strut (70) connected to the first docking arm (30) and a first arm pod (75) and first drag dish (80) connected to the first arm pod (75). The drag dishes can be suspended from the arm struts to a water depth below significant wave action for stabilizing the floating vessel. The second docking arm (35) includes a second arm strut (85) connected to the second docking arm (35) and an second arm pod (90) to which is connected a second drag dish (95). The arm pods in this embodiment provide buoyancy to support the arm struts (70 and 85). The arm pods are preferably water tight chambers holding air. The docking arms are aided in movement by arm cylinders, such as hydraulic arm cylinders, in which the first arm cylinder (105) is connected to the bridge (10) and the second arm cylinder (110) is connected to the bridge (10).

A control room (100) with a control center (102) provides a computerized navigation system which connects to a propulsion control for operating azimuth thrusters, and a dynamic positioning system (DPS) for providing accurate maneuverability by the operator for the portable, floatable vessel. The control center (102) can be provided with additional controllers, such as computer controlled levers, for operating the docking arms.

Figure 2:
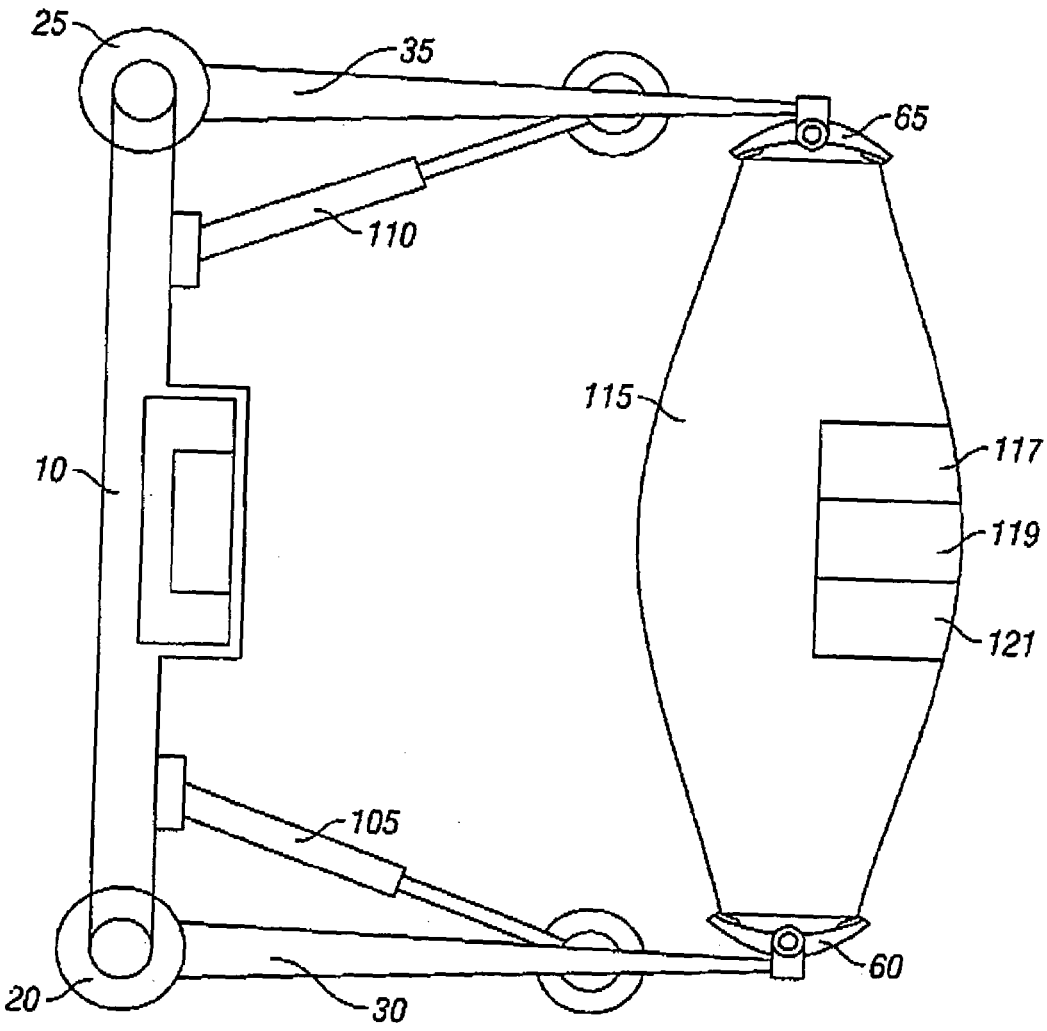
FIG. 2 depicts a top view of an embodiment of the portable, floatable vessel holding a floating craft.

FIG. 2 depicts a top view of an embodiment showing the portable floating vessel positioning and stabilizing a lightering craft. The first and second docking arms (30 and 35) are rotatably connected to and extend from the first and second struts (20 and 25). The struts are connected to the bridge structure (10). The first and second docking arms can include a first docking bracket (60) and a second docking bracket (65), respectively, for firmly gripping and stabilizing a lightering craft (115) with cargo (117, 119, and 121). The docking arms are aided in movement by arm cylinders in which the first arm cylinder (105) is connected to the bridge structure (10) and the second arm cylinder (110) is connected to the bridge. The docking arms (30 and 35) can become fully extended and can swing outward to an angle of 120 degrees with the bridge structure for firmly gripping the lightering craft.

While these embodiments have been described with emphasis on the embodiments, it can be understood that within the scope of the appended claims, the embodiments might be practiced other than as specifically described herein.

What is claimed is:

1. A portable, floatable vessel for stabilizing a floating craft comprising:

a. a bridge structure;

b. a lifting bridle connected to the bridge structure;

c. a first strut comprising a first end and a second end, wherein the first end engages the bridge structure and the second end engages a first machinery pod comprising an first azimuth thruster;

d. a second strut comprising a second strut first end and a second strut second end, wherein the second strut first end engages the bridge structure and the second strut second end engages a second machinery pod comprising a second azimuth thruster;

e. a first docking arm rotatably mounted to the first strut and a second docking arm rotatably mounted to the second strut;

f. a first docking bracket connected to an end of the first docking arm opposite the bridge structure and a second docking bracket connected to an end of the second docking arm opposite the bridge structure, wherein the first and second docking brackets engage the floating craft;

g. a first docking arm strut connected substantially perpendicular to the first docking arm and a second docking arm strut connected substantially perpendicular to the second docking arm;

h. a first arm pod for providing buoyancy connected to the first docking arm strut and a second arm pod for providing buoyancy connected to the second docking arm strut;

i. a first drag dish connected to the first arm pod and a second drag dish connected to the second arm pod;

j. a first arm cylinder connected between the bridge structure and the first docking arm and a second arm cylinder connected between the bridge structure and the second docking arm; and k. a control center located on the bridge structure, wherein the control center communicates with the first and second machinery pods, the first and second azimuth thrusters, the first and second docking arms, and the first and second arm cylinders.

2. The system of claim 1, wherein the first strut and the second strut comprise: an engine exhaust, electrical wiring, and conductors.

3. The system of claim 1, wherein the first machinery pod comprises a first diesel-engine hydraulic power unit for actuating the first azimuth thruster and actuating the first docking arm and the first arm cylinder.

4. The system of claim 1, wherein the second machinery pod comprises a second diesel-engine hydraulic power unit for actuating the second azimuth thruster and actuating the second docking arm and second arm cylinder.

5. The system of claim 1, wherein the portable, floatable vessel comprises laser rangers connected to the bridge structure in communication with the control center.

6. The system of claim 1, wherein the control center further comprises: a dynamic positioning system (DPS) interacting with a navigation system for the portable, floatable vessel and the first and second machinery pods.

7. The system of claim 1, wherein the control center further comprises a vessel joy-stick controller for the floating vessel.

8. The system of claim 1, wherein the control center comprises a remote control transmitter and receiver for accepting and sending navigation information remotely for unmanned operation.

9. The system of claim 1, wherein the first and second docketing brackets comprise a shape matching contact points of the floating vessel.

10. A method for providing dynamic positioning and stabilization of a floating craft using a portable, floatable vessel, comprising the steps of:

a. lifting a portable, floatable vessel to transfer the portable, floatable vessel from a supply ship to water, wherein the portable, floatable vessel comprises:

i. a bridge structure;

ii. a lifting bridle connected to the bridge structure;

iii. a first strut comprising a first end and a second end, wherein the first end engages the bridge structure and the second end engages a first machinery pod comprising an first azimuth thruster;

iv. a second strut comprising a second strut first end and a second strut second end, wherein the second strut first end engages the bridge structure and the second strut second end engages a second machinery pod comprising a second azimuth thruster;

v. a first docking arm rotatably mounted to the first strut and a second docking arm rotatably mounted to the second strut;

vi. a first docking bracket connected to an end of the first docking arm opposite the bridge structure and a second docking bracket connected to an end of the second docking arm opposite the bridge structure, wherein the first and second docking brackets engage the floating craft;

vii. a first docking arm strut connected substantially perpendicular to the first docking arm and a second docking arm strut connected substantially perpendicular to the second docking arm;

viii. a first arm pod for providing buoyancy connected to the first docking arm strut and a second arm pod for providing buoyancy connected to the second docking arm strut;

ix. a first drag dish connected to the first arm pod and a second drag dish connected to the second arm pod;

x. a first arm cylinder connected between the bridge structure and the first docking arm and a second arm cylinder connected between the bridge structure and the second docking arm; and xi. a control center located on the bridge structure, wherein the control center communicates with the first and second machinery pods, the first and second azimuth thrusters, the first and second docking arms, and the first and second arm cylinder; and b. gripping the floating craft with the first docking bracket and the second docking bracket forming a multi-hull structure with the floating craft and the portable floating vessel; and c. using the dynamic positioning system and the azimuth thrusters to maintain the floating craft adjacent to the supply ship while minimizing motion of the floating craft.

11. The method of claim 10, further comprising the step of using the azimuth thrusters to maneuver the floating craft to a position away from the supply ship.

12. The method of claim 10, further comprising the step of releasing the first docking bracket and the second docking bracket to release the floating vessel.

13. The method of claim 10, further comprising the step of lifting the portable, floatable vessel using the lifting bridle and storing the portable floatable vessel on the supply ship.

* * * * *